US005893250A

United States Patent [19]

Benvenuto et al.

[11] Patent Number: 5,893,250

[45] Date of Patent: Apr. 13, 1999

[54] DROP CEILING SYSTEM

[76] Inventors: Guido Benvenuto, 8870 Broderick Road, Windsor, Ontario, Canada, N9A 6Z6; Lanny Elliott, 2018 Charlene Street, Tecumseh, Ontario, Canada, N9K 1B1; Dino Coletti, 2941 St. Clair Avenue, Windsor, Ontario, Canada, N9E 4A1

[ * ] Notice: This patent is subject to a terminal disclaimer.

[21] Appl. No.: 08/962,107

[22] Filed: Oct. 31, 1997

Related U.S. Application Data

[63] Continuation-in-part of application No. 08/554,312, Nov. 8, 1997, Pat. No. 5,687,526.

[51] Int. Cl.[6] ..... E04B 9/18

[52] U.S. Cl. ..... 52/506.08; 52/506.06; 52/506.09; 52/506.1; 52/592.1

[58] Field of Search ..... 52/506.05–506.1, 52/592.1

[56] References Cited

U.S. PATENT DOCUMENTS

| | | | |
|---|---|---|---|
| 2,143,980 | 1/1939 | Guastavino . | |
| 2,935,152 | 5/1960 | Maccaferri . | |
| 3,014,564 | 12/1961 | Thomsen et al. . | |
| 3,195,700 | 7/1965 | Kemp | 52/506.1 |
| 3,241,282 | 3/1966 | Kemp | 52/506.1 |
| 3,312,028 | 4/1967 | Schroyer | 52/506.1 X |
| 3,549,114 | 12/1970 | Eiermann et al. . | |
| 5,050,360 | 9/1991 | Gailey | 52/506.06 |
| 5,177,923 | 1/1993 | Nemchock . | |
| 5,177,929 | 1/1993 | Reynolds | 52/506.1 X |
| 5,687,526 | 11/1997 | Benvenuto et al. | 52/506.06 X |

FOREIGN PATENT DOCUMENTS

| | | | |
|---|---|---|---|
| 1175977 | 4/1959 | France . | |
| 1207244 | 2/1960 | France | 52/506.09 |
| 1259547 | 1/1968 | Germany . | |
| 3232449 | 3/1984 | Germany | 52/506.1 |
| 941911 | 11/1963 | United Kingdom . | |

OTHER PUBLICATIONS

Appendix 3 "Installation Instructions for Current Track System".

*Primary Examiner*—Robert Canfield
*Attorney, Agent, or Firm*—Dykema Gossett PLLC

[57] ABSTRACT

A ceiling has elongated suspension members that attach to ceiling joists or structure and an interlocking tile mechanism. The individual tiles are provided with opposed side walls having mating interlock features for aligning and supporting a network of suspended tiles.

30 Claims, 7 Drawing Sheets

DROP CEILING SYSTEM

This application is a continuation-in-part of application application Ser. No. 08/554,312 filed on Nov. 8, 1997, now U.S. Pat. No. 5,687,526.

TECHNICAL FIELD

The present invention relates generally to suspended ceilings having a plurality of ceiling tiles and, more specifically, to an improved suspended ceiling system which does not require the use of a support grid.

BACKGROUND OF THE INVENTION

A number of different systems and structures exist for providing a drop or suspended ceiling in a room. As will be appreciated by those skilled in the art, suspended ceilings are assembled such that they are spaced a predetermined distance below the ceiling joists, in contrast to ceilings which are mounted directly on strips attached to a ceiling joist or original ceiling structure. Suspended ceilings generally comprise a plurality of individual ceiling tiles. The individual tiles may take a number of overall geometries, but are typically rectangular or square. Also, many different materials are used to fabricate ceiling tiles such as pressed fibrous materials or synthetic polymers. In particular, it is known to use synthetic resins to form precast ceiling tiles which are both lightweight, washable and durable. These precast tiles may be provided with an embossed or textured surface to add an aesthetically pleasing appearance to the tile surface which is exposed to view when installed.

The most common drop ceiling system currently in use requires a complicated track system which aligns and supports the individual tiles. It will be appreciated that for proper installation of the tiles, the grid and tiles must meet a number of geometrical requirements. That is, the faces of the tiles must generally lie in a single plane so that a uniform surface is obtained. The tiles must generally be positioned in orderly arrays of rows and columns, although in some configurations alternating rows or columns may be offset a predetermined uniform distance. In any event, the ceiling tiles are generally arranged such that a uniform pattern is created. In addition, there must be means by which the tiles can accommodate variances in the geometry of the ceiling space at corners, pillars and the like, as well as around the perimeter of the ceiling space.

In one conventional track system, after marking the height of the ceiling to be installed, a wall angle molding is attached to the walls around the inside perimeter thereof at the point where the ceiling is to be installed. The moldings are cut to length and the outside corners mitered. Main T support members must then be cut to length so that cross-T slots line up with cross-T points of the previously installed molding. The main Ts run parallel to the room center line and are perpendicular to the ceiling joists. Metal hangers are installed which support the main Ts. The main T is typically provided in sections which are connected together to form a continuous run. Cross-Ts are then installed which run perpendicular to the main Ts to form a grid that supports the individual ceiling tiles or panels. Again, the cross-Ts must be measured and cut to the proper dimensions and are then locked into the main Ts. In most instances the Ts are fabricated of metal and must be cut with tin snips or the like with any burrs and sharp edges being filed off as necessary.

One such suspended ceiling construction which describes the use of "T-bar" and "Z-bar" supporting grid structures is described in U.S. Pat. No. 4,070,840, entitled "Suspended Ceiling Construction." This prior art patent points out that grid systems of this type suffer from a number of drawbacks, including the fact that the flanges on the T bars are fully visible from below the ceiling, impairing the aesthetic qualities of the ceiling and making it necessary to employ finished metal in the T-bars so that the visible portions will be as unobtrusive as possible. Concealed grid T-bar structures are also described therein, but it is pointed out that the tiles in most such systems are not removable and must be broken to gain access to the space above as suspended ceiling.

In order to eliminate the many disadvantages associated with ceiling track systems, some effort has been made in the prior art to develop trackless ceiling systems. For example, in British patent specification 941,911 of Mar. 15, 1960, a ceiling system made up of a plurality of ceiling tiles is disclosed which does not require a true supporting grid or special substructure. More specifically, the aforementioned patent specification provides "a suspended under ceiling comprising an assembly of elements adapted to be hung up and each of which are provided with limbs or walls on all sides, characterized by the feature that the limbs or walls of the neighboring elements are interconnected together by means of connecting members, and are suspended directly from a supporting structure at individual points by means of hangers or wires." The connecting of the ceiling elements to one another may be affected for instance by means of clips, rivets, screws, adhesives or like means. For the accommodations of the connecting members the limbs or walls of the ceiling elements are provided with perforations.

In U.S. Pat. No. 3,549,114, entitled "Suspension Means For Fall Ceilings" a suspension system for ceilings composed of panels is described which is adapted to have its lower end engaged. Recesses are provided in upwardly directed flanges which are formed at the edges of the ceiling panels. The lower end of the suspension system is equipped with two differently shaped tongues, one of which is formed into a supporting hook to be engaged in a recess of the edge flanges of the tiles. The other tongue is adapted to form a safety catch which extends across the supporting hook to contact the upper edge of one of the edge flanges.

In U.S. Pat. No. 2,935,152, "Acoustical Units And Installed Assemblies Thereof" plastic forms of acoustical tiles are described which include an interlock feature between adjacent abutting tiles and an installed assembly of the tiles. It is claimed that the interlocking system aids in the precise mounting and assembly of the tiles into the desired installed positions relative to each other and functions to maintain the tiles in their assembled positions as an interlocked composite structure.

Although these purported trackless ceiling systems attempt to address the problems associated with the elimination of a supporting grid, they suffer from a number of drawbacks such as requiring difficult installation procedures, complicated or unreliable mounting structures; moreover, many prior art systems are difficult to manufacture or are otherwise unacceptable to consumers such that trackless drop ceiling systems have not gained wide spread acceptance in the marketplace.

SUMMARY OF THE INVENTION

In one aspect the present invention provides a ceiling tile system having a plurality of tiles, each of said tiles having multiple attachment sites for elongated suspension members. Each tile is further provided with integral interlocking support and alignment structures that engage mating structures on abutting adjacent tiles. The elongated suspension members are secured to cross members, thereby suspending the tiles to form a drop ceiling.

In another aspect the elongated suspension members have hanger portions that couple to a suspended support member.

One advantage of this configuration is that an existing support grid may be used to support the ceiling tiles. The support grid, however, will not be visible since the tiles use the elongated suspension members for support rather than the grid.

The tiles are interlocked by mating interlocking support and alignment structures on adjacent tiles. The interlocking structure has a first and second interlocking structure. The first interlocking structure has a first vertically extending wall having a groove. The second interlocking structure has a second vertically extending wall having a flange extending therefrom. The flange has a third vertical wall coupled to the flange. A locating tooth extends between the second vertical wall and third vertical wall. The locating tooth corresponds to the groove in the first interlocking structure.

It is a further object of the present invention to provide a suspended ceiling which is easy to install and which provides a generally uninterrupted planar ceiling surface.

The foregoing and other objects, features and advantages of the invention will be apparent from the following more particular description in the preferred embodiments of the invention as illustrated in the accompanying drawings.

DETAILED DESCRIPTION OF THE PREFERRED EMBODIMENTS OF THE INVENTION

Figure 1:
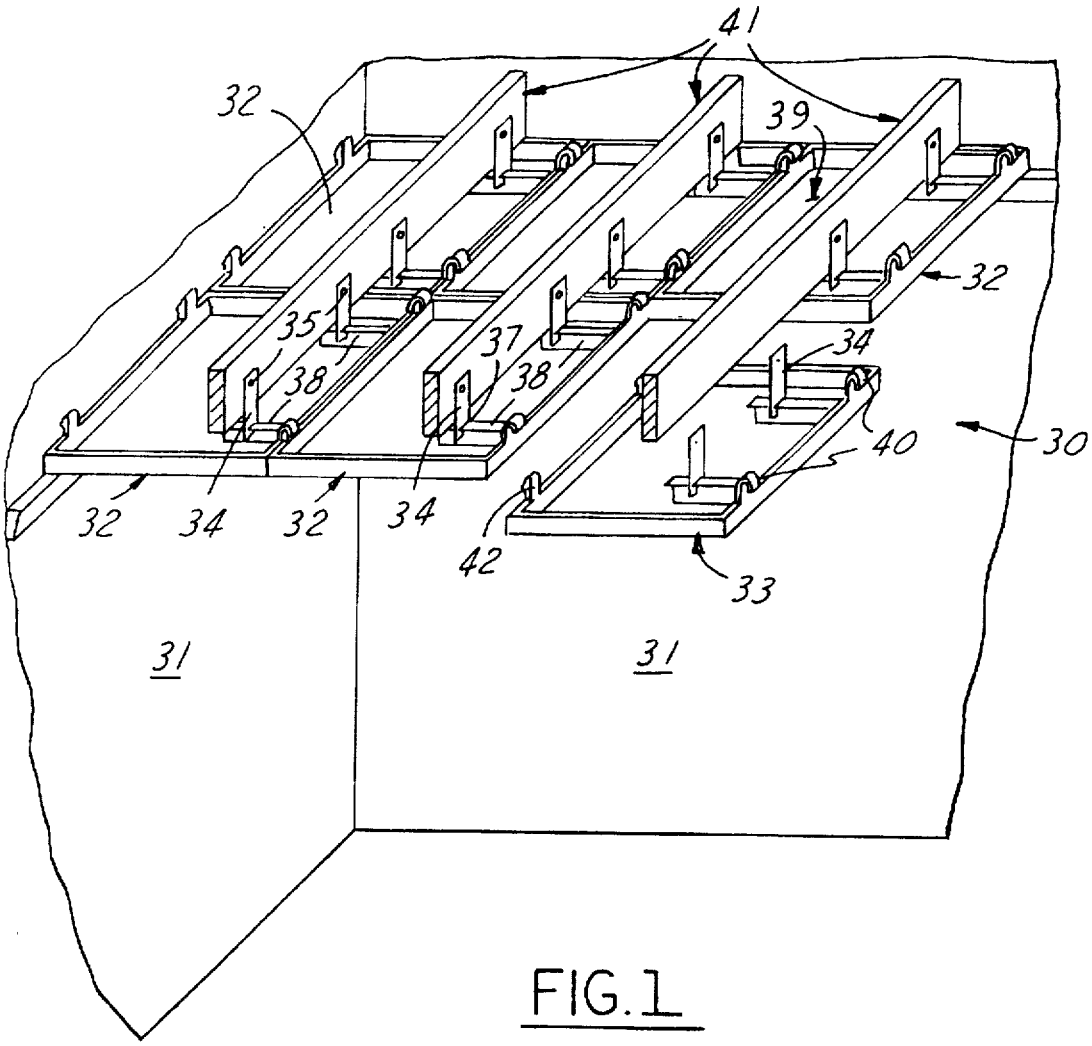
FIG. 1 is a perspective view illustrating the configuration and installation of the trackless ceiling tile system of the present invention in an intermediate stage of construction.

Referring now to FIG. 1 of the drawings, trackless ceiling tile system 30 is shown (suspended between walls 31 of a room) in one embodiment generally having a plurality of ceiling tiles or panels 32 which are arranged in a regular array or matrix of rows and columns. It is to be understood that although the drawings depict tiles 32 as having a square geometry, rectangular, or other polygonal shapes may be employed as well as other alignment configurations such as alternating offsetting or staggered rows; such modifications are deemed to be within the scope of the present invention. In FIG. 1, tile 33 is shown being raised to its installed position on ceiling joist or member 41.

Each tile 32 is provided with an elongated suspension member 34 which is attached at one end to a ceiling joist by fastener 35. The other or lower end 36 of each elongated suspension member 34 is provided with a slot 37 which receives and engages T block or channel 38 which is molded into back surface 39 of each tile 32. In one embodiment of the present invention, each tile 32 is provided with two such cooperating suspension member/tile attachment point assemblies. It will be appreciated by those skilled in the art that it may be possible to use fewer suspension/attachment sites or that more than two such sites may be desirable in a particular application.

Along one edge of each ceiling tile 32, an interlock structure, shown here as vertical half-carrot snap channel 40, is provided which engages mating interlock structure of an adjacent tile, provided along the edge thereof. Again, it may be desirable to use fewer interlocking sites or more than two such sites in a particular application. Details of assembly and construction of ceiling tile system 30 and the individual tiles will be more fully described hereinafter.

Figure 2:
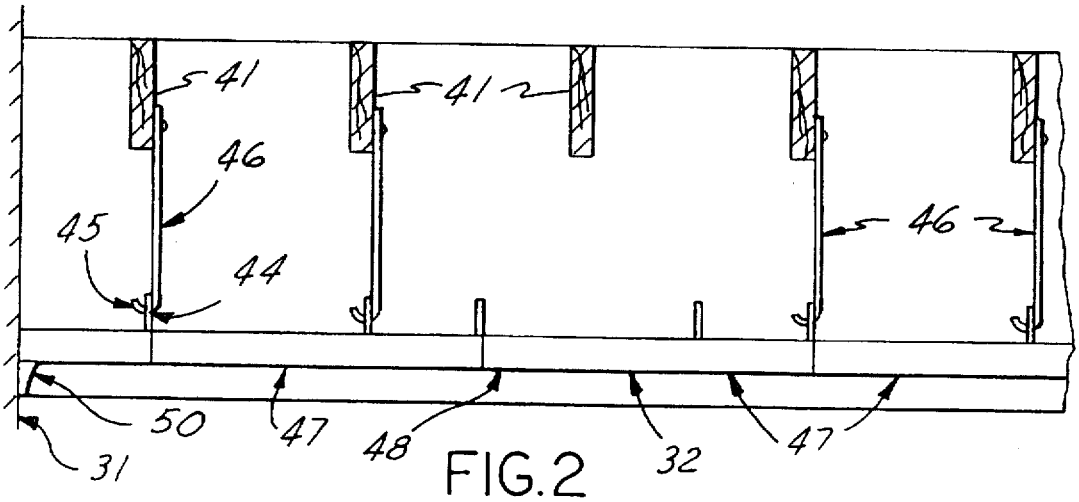
FIG. 2 is an elevational view of a trackless ceiling tile system assembled in accordance with the present invention.

Referring now to FIG. 2 of the drawings, trackless ceiling tile system 30 is shown with like reference numerals depicting like parts and with a modified suspension/attachment configuration. More specifically, in the embodiment shown in FIG. 2 of the drawings, each tile 32 is provided with a vertically projecting slotted tab 44 which receives U-shaped end 45 of J hook 46. FIG. 2 demonstrates that once installed, the show surfaces 47 of tiles 32 form a single co-planar ceiling tile surface 48 by virtue of the suspension system and interlocking tile features. Crown or wall molding 50 as shown serves the traditional function of concealing the intersection of the perimeter tiles with the wall surfaces and supports the perimeter tiles.

Figure 3:
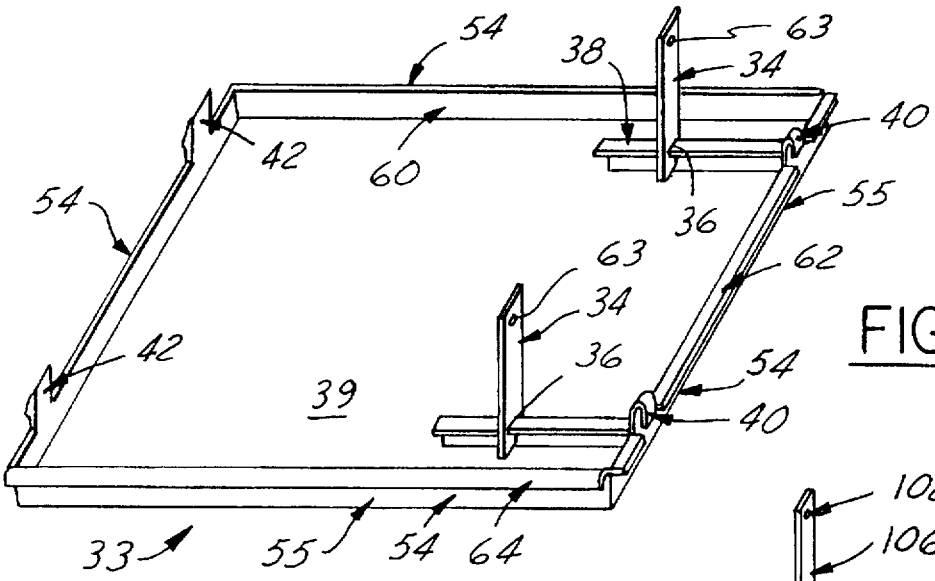
FIG. 3 is a perspective view of the top surface of a single ceiling tile provided in one configuration in accordance with the present invention and illustrating support and interlock structures.

Referring now to FIG. 3 of the drawings, one tile 33 of assembly 30 of FIG. 1 is shown in detail. Tile 33 may be formed of a number of materials, but is preferably formed of a synthetic polymer; that is, tile 33 is preferably made of plastic. Preferred plastics used to form tile 33 are polyvinylchloride polypropylene and acrylic-butadine-styrene. Back side stiffening ribs may or may not be present based on material properties and application requirements. The preferred method of fabrication is plastic injection molding, although compression molding or vacuum forming may be suitable in some applications. The design and configuration of suitable molds will be apparent to those skilled in the art based on the teaching of the present specification.

As stated earlier, the geometry of tile 33 may vary depending upon the ceiling tile pattern desired, but in most instances tile 33 has a thickness of from about 1.0 mm to 10 mm or more preferably about 2.0 mm to about 5.0 mm. Tile 33 in the specific configuration depicted in FIG. 3 of the drawings is a square tile with the length of each side being from about 12" to about 48". Back surface 39 lies at the floor of vertical perimeter side walls 54 such that the tiles are in the form of a tray or the like having side walls.

In the most preferred embodiment, each tile 33 is provided with a blackout flange 62 along one vertical side wall and a U-channel flange 64 along another side wall 54. Two other opposing side walls do not have flanges. The purpose and function of flanges 62 and 64 will be explained more fully hereinafter.

T block 38 is shown mounted on back surface 39 of tile 33. Elongated suspension member 34 in this particular embodiment is a thin (1.0 to 5.0 mm in thickness) molded plastic strip or the like having a hole or holes 63 which receives a screw of other fastening means. As been seen in FIG. 10 of the drawings, lower end 36 of suspension strap 34 in one embodiment is notched or slotted to form a T-shaped space which is slidingly fitted onto T-shaped block 38 such that strap 34 securely engages block 38. This slide-on attachment allows tile 33 to be properly positioned in the ceiling tile matrix such that it can accommodate variances in the positioning of the ceiling joist 41. Block 38 is preferably integrally molded as a part of tile 33 although it is conceivable that it could be a discrete element attached by an adhesive or the like to the back surface 39 of tile 33. Blocks 38 are positioned to one side of tile 33 and may extend to one vertical side wall 54. Although two blocks 38 (and straps 34) are depicted in the drawing, it may be possible to use a single block and strap assembly or more than two block and strap assemblies in some applications.

Figure 15:
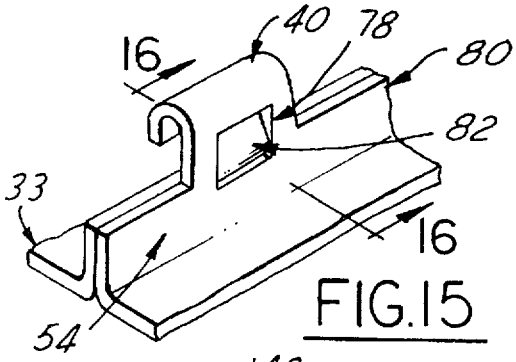
FIG. 15 is fragmentary perspective view of a portion of two interlocked tiles in accordance with the present invention in which the interlocking design includes a U-shaped channel having a slot in one wall thereof which receives and engages a fastener projection.
Figure 16:
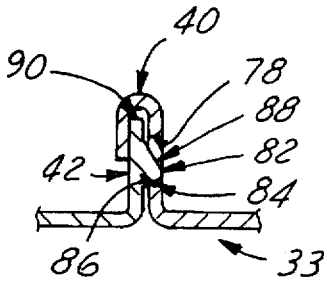
FIG. 16 is a cross-section alone lines 16—16 of FIG. 15.

Tile 33 provides interlocking structures which cooperate with mating structures on adjacent tiles in order to interlock the tiles into the stable array of FIG. 1. As shown in FIG. 3, 15 and 16 of the drawings, in a preferred embodiment of the present invention, this interlocking feature takes the form of an inverted U-shaped structure or channel 40 along one side wall 54, here, the side wall to which T-blocks 38 extend. In most embodiments, vertical side walls 54 will project from about 5.0 to about 25.0 mm above back surface 39. Vertical side walls 54 thus provide a surface 55 which is flat and which abuts a like surface on the vertical side wall of an adjacent panel.

Inverted U-shaped channel 40 has a channel-shaped portion 74 that defines a slot 78 which extends therethrough. In FIGS. 15 and 16, the cooperation between two panels 33 to form an interlock is shown in which vertical half carrot 42 has carrot projection 82 that snaps into slot 78 as best shown in FIG. 16. That is, carrot projection 82 has a beveled face 88 and a lower surface 84 which fits within slot 78 such that lower surface 84 engages lower slot surface 86. Top 90 of vertical half carrot 42 is secured within channel-shaped portion 74 of U-shaped fastener 40. Although upper edges of vertical side walls 54 are shown in FIG. 15, in the most preferred embodiment, as shown in FIG. 3, vertical blackout flange 62 on the tile side wall 54 having inverted U-shaped interlock fastener 40 would conceal the upper edge 80 of the side wall 54 having the half carrot. By providing blackout flange 62 and U channel flange 64, which performs a similar function in that it engages a straight non-flanged side wall of an adjacent panel, greater stability and substantially light-sealed seams are provided by the present invention.

Thus, it is to be understood that in the present invention, in the most preferred embodiment, each tile 32 has a vertical side wall 54 that has one-half of an interlocking structure and the opposite edge or side wall 54 has the mating interlocking structure; these interlock structures cooperate with the mating structure of adjacent tiles. One of the side walls having the interlock structure has a flange and the opposed wall 54 is non-flanged such that cooperating engagement provides a single flange covering the same. Similarly, the opposed side walls 54 which do not have interlocking structures cooperate with adjacent tiles, with one of the side walls being U-channel flange 64 and the opposed side wall 54 being non-flanged.

Figure 4:
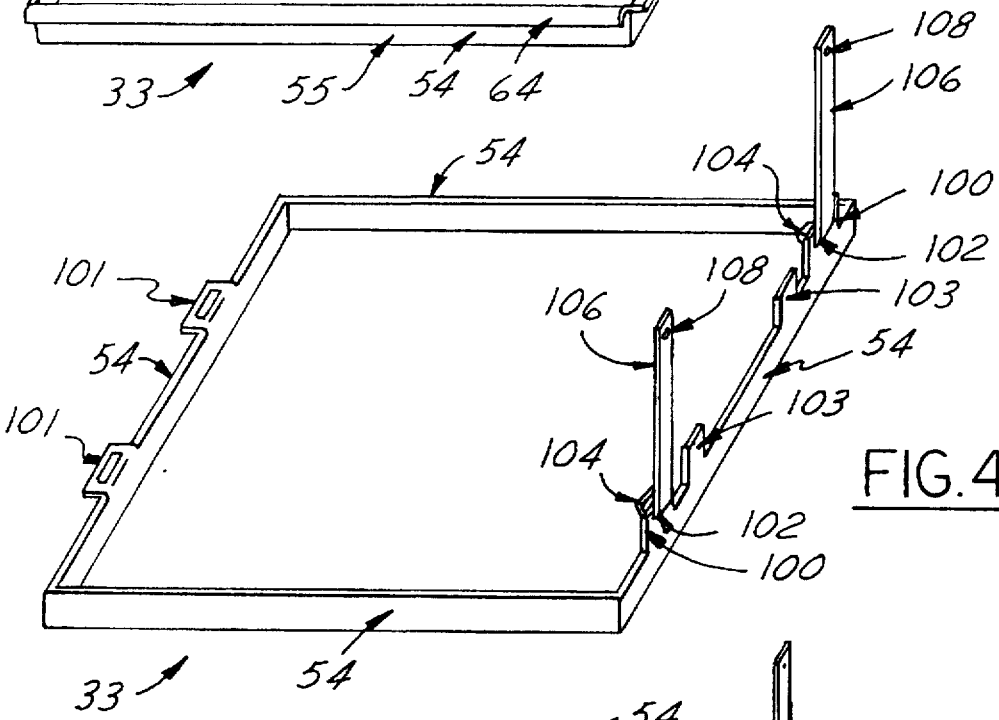
FIG. 4 is a perspective view of a ceiling tile of the present invention in another configuration.
Figure 6:
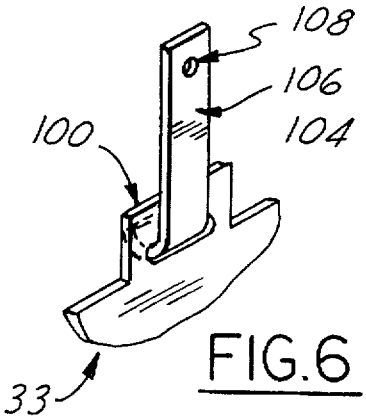
FIG. 6 is a fragmentary section of a portion of one tile of the present invention illustrating an elongated suspension member inserted into a slot on a portion of the tile.
Figure 13:
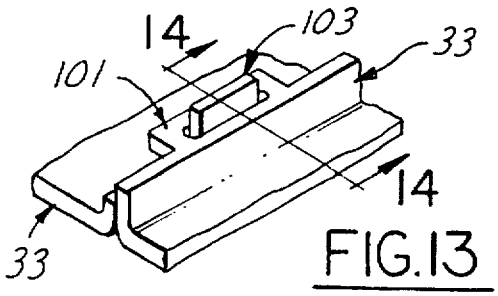
FIG. 13 is a fragmentary perspective view of a portion of two interlocked tiles in accordance with the present invention in which the interlocking support and alignment structure is a vertical tab which projects through a horizontal slotted tab.
Figure 14:
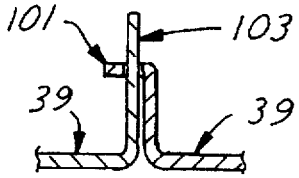
FIG. 14 is a cross-section along lines 14—14 of FIG. 13.

Referring now to FIG. 4 of the drawings, tile 33 is shown in an alternative embodiment in which vertical slotted tabs 100 are provided as best shown in FIG. 6 of the drawings. Vertical slotted tabs 100 have slots 102 extending therethrough which serve to receive U-shaped ends 104 of elongated suspension member 106. Thus, slotted tab 100 projects above vertical side wall 54 of tile 33. Fastening hole 108 is provided which receives a screw or the like in order to attach elongated suspension member 106 to a joist or ceiling structure. It is to be understood that although fastener-receiving holes are depicted in a number of embodiments of the present invention, other fastening means such as nails, staples or the like may also be used to attach the elongated suspension members to the joists without the use of preformed holes. Elongated suspension member or J hook 106 may be formed of a number of materials and is most preferably formed of the same material from which tile 33 is fabricated. It will be appreciated that the suspension structure of FIG. 6 is essentially that shown in FIG. 2 of the drawings. In this embodiment, the interlocking mechanism consists of horizontal slotted tabs 101 and vertical tabs 103 as best shown in FIGS. 13 and 14 of the drawings.

In FIGS. 7, 8, 9, 11 and 12, various modifications of the suspension system of the present invention are shown. More specifically, and referring now to FIG. 7 of the drawings, in one embodiment of the present invention a flexible strap 110, such as a woven material, nylon plastic sheet, or a thin metal strip is molded into side wall 54 of tile 33. Composite molding techniques for embedding flexible strap 110 in tile side wall 54 will be known to those skilled in the art. By providing a flexible strap 110, freedom is achieved in terms of positioning the tiles relative to the ceiling joists or structure. In this embodiment, straps 110 can easily be stapled to the floor joist using a power stapler or the like.

Figure 8:
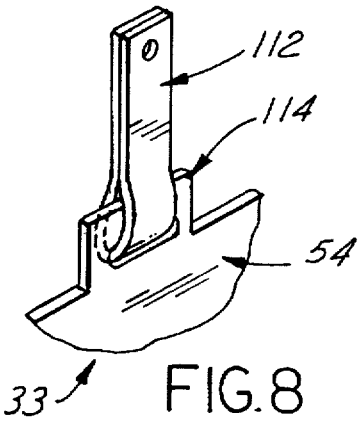
FIG. 8 is a fragmentary perspective view of one tile of the present invention in another embodiment illustrating the use of a flexible elongated suspension member looped through the slot of a vertically extending tab on the tile.
Figure 9:
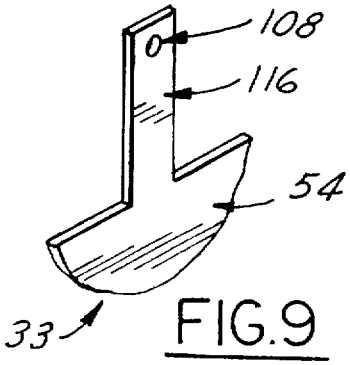
FIG. 9 is a fragmentary perspective view of a portion of a tile made in accordance with the present invention in another configuration in which the elongated suspension member is integrally molded in the tile.

Referring to FIG. 8 of the drawings, looped flexible strap 112 is shown which again can be formed of a flexible woven material, nylon sheet or metal strip. Here, a vertical slotted tab 114 is provided through which strap 112 extends. Referring to FIG. 9 of the drawings, elongated suspension member 116 is an integral extension of side wall 54. In this embodiment, essentially no separate parts other than the fastener for securing elongated suspension member 116 to the ceiling joist or structure is necessary.

Figure 10:
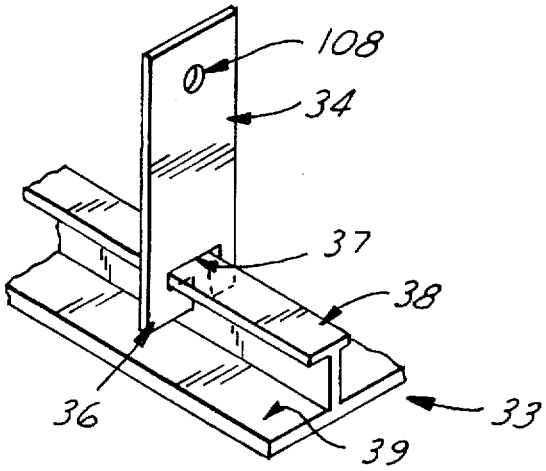
FIG. 10 is a fragmentary perspective view of a portion of a tile in accordance with the present invention in another configuration in which the elongated suspension member has a T slot at one end which receives a T channel or bar formed integrally on the tile.
Figure 7:
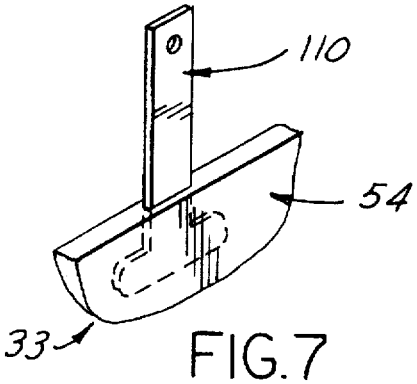
FIG. 7 is a fragmentary perspective view of a portion of one tile made in accordance with the present invention in which the elongated suspension member is insert molded into the tile body.
Figure 11:
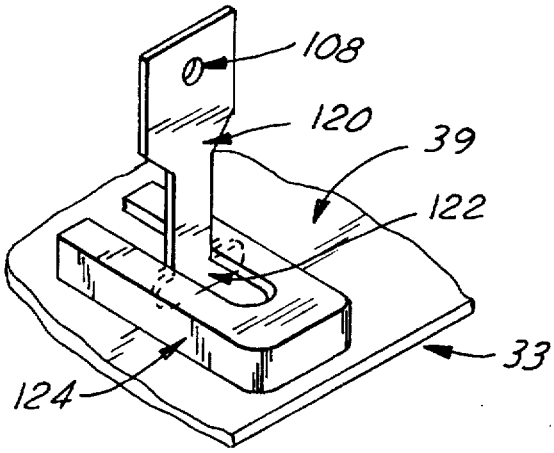
FIG. 11 is a fragmentary perspective view of a portion of a tile made in accordance with the present invention in another embodiment in which a slotted channel is provided on the tile and the elongated suspension member has a T-shaped end and engagingly cooperates with the slotted channel of the tile.
Figure 12:
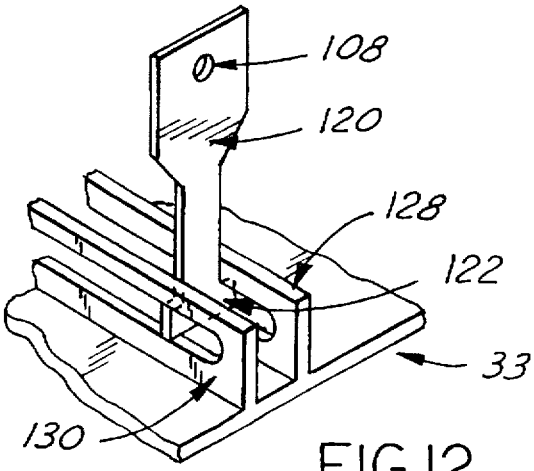
FIG. 12 is a fragmentary perspective view of a portion of a tile made in accordance with the present invention in another embodiment in which parallel slotted walls are provided on the tile and wherein the elongated suspension member has a T-shaped end that engagingly cooperates with the slotted parallel walls of the tile.

In FIG. 11 of the drawings, a slide-on suspension system is shown which is a variation of that shown and described in connection with FIG. 10 of the drawings. In this particular embodiment, elongated strap 120 is provided with T-shaped end 122 shown in phantom. T-shaped end 122 slides within slotted housing 124 which projects from back surface 39 of tile 33. Housing 124 is preferably integrally molded with tile 33 although it can be formed as a discrete element and later attached. In FIG. 12 of the drawings, a further modification has been made in which housing 124 is replaced with a set of parallel slotted walls 128 and 130.

Figure 5:
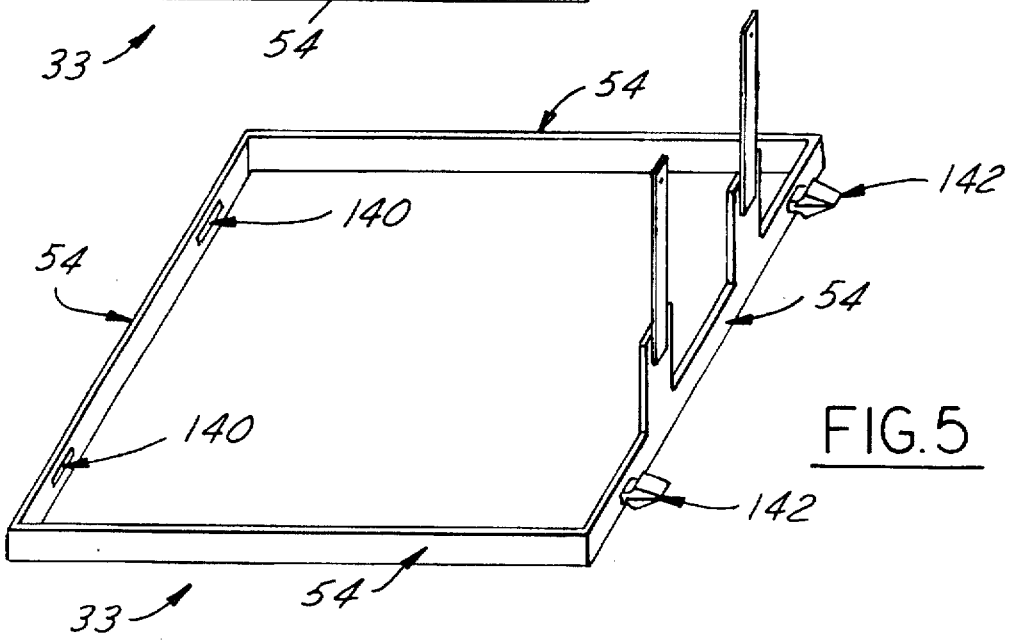
FIG. 5 is a perspective view of a ceiling tile of the present invention in another configuration.
Figure 17:
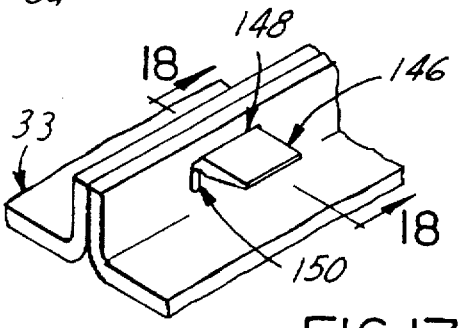
FIG. 17 is a fragmentary perspective view of a portion of two interlocked tiles made in accordance with the present invention in which one tile has a vertical slotted wall and the other tile has a horizontal fastener projection that interlocks the two tiles.

Referring now to FIG. 5 of the drawings, in still another embodiment, tile 33 has the J hook and slotted vertical tab suspension configuration of FIG. 6 of the drawings, but rather than being positioned near the corners of tile 33, they are placed closer to the center line of the tile. In this embodiment, the interlocking feature comprises a pair of slots 140 in side wall 54 which receive compressible carrots 142 of an adjacent tile. It should be noted that although the edge flanges for closing the seams between the tiles is described earlier are not shown in FIGS. 4 and 5, their incorporation into these alternative tile structures will typically be desirable. Referring now to FIGS. 19 and 20 of the drawings, compressible fasteners or carrots 142 are shown extending through slot 140 of side wall 54 of panel 33. Carrot 142 is an accordion-like shape. It compresses as it is passed through slot 144 and then expands somewhat such that back edges 144 prevent fastener 142 from disengagement. Similar arrangements are shown in FIGS. 17 and 18 and FIGS. 21 and 22. In FIG. 17, fastener 146 engages through slot 148 by allowing a relief slot extension 150 at each end of slot 148. FIG. 21 shows notched locking tongue 152 engaged into slot 154.

Figure 18:
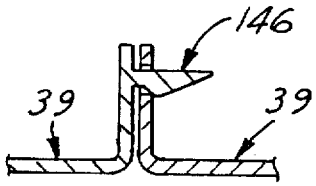
FIG. 18 is a cross-sectional view along lines 18—18 of FIG. 17.
Figure 19:
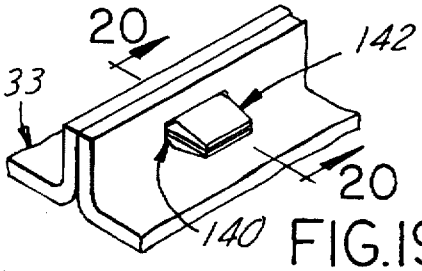
FIG. 19 is a fragmentary perspective view of a portion of two interlocked tiles in accordance with the present invention in which the interlocking feature comprises a slotted vertical wall on a tab which is engaged by a horizontal projecting fastener member.
Figure 20:
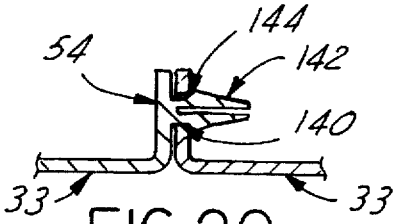
FIG. 20 is a cross-sectional view along lines 20—20 of FIG. 19.
Figure 21:
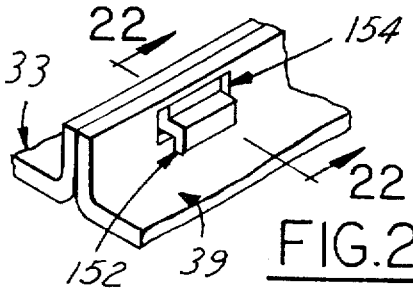
FIG. 21 is a fragmentary perspective view of a portion of two interlocked tiles in accordance with the present invention in which one tile has a slotted vertical wall which receives a notched fastener projection extending from an enjoining tile.
Figure 22:
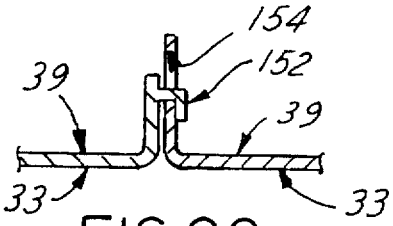
FIG. 22 is a cross-section of the structure shown in FIG. 21 along lines 22—22.

Stated in another way, in FIG. 13, the interlocking mechanism of the present invention is in the nature of a connecting tongue and eye; in FIGS. 15 and 16 the interlock comprises a vertical half carrot snap; in FIGS. 17 and 18, the interlocking mechanism comprises a horizontal half carrot snap; in FIGS. 19 and 20, the interlocking feature is a full carrot fastener; and in FIGS. 21 and 22 the interlocking system is a locking tongue.

It is intended in the present invention that in many instances it will be desirable to provide precolored tiles 33 and this can be achieved by using a colorant or dye in the plastic used to form the tiles or the tiles can simply be painted before or after installation. In addition, numerous additives such as U.V. stabilizers, flame retardants and other such additives may be included in the tiles. It is also contemplated that it may be desirable in some instances to pre-install thermal or acoustic installation on back surface 39 of the tile and fiberglass, expandable foam, or other insulating material can be used for this purpose. In addition, this insulating material can be insert molded directly to the tile, or the tile wall may be foamed to create a thicker wall and achieve thermal or acoustical properties.

Referring again to FIG. 1 of the drawings, trackless ceiling tile system 30 of the present invention is installed in the following manner. First, the desired ceiling height is determined relative to walls 31. Walls 31 are then marked with a level line around the perimeter of the room. A number of techniques for marking a level chalk line will be known to those skilled in the art.

Next, crown mold 50 (shown in FIG. 2 of the drawings) is installed on two starting walls, preferably one end wall parallel to the ceiling joist or structure and the adjacent wall to the right of this wall. Molding 50 serves the important function of supporting that end of the wall tiles which are not suspended by an elongated suspension member or otherwise supported. This is best shown in FIG. 2 of the drawings.

Following installation of crown or wall molding 50, tile placement is premeasured so that the wall tiles (the tiles that abut the surrounding walls) have an aesthetically appealing area. Corner tiles are cut (and note that the plastic construction of the present invention facilitates installation by allowing the tiles to be easily scored and broken into the proper dimensions) and installed. The corner tile is placed on the abutting crown moldings and, using a level placed on back surface 39 of the tile, the tile is leveled and the elongated suspension strap is adjusted and secured at the proper length to the ceiling joist using a nail, or a staple or the like.

It will be appreciated that the interlocking tabs, i.e., half carrot snap tabs 40 in FIG. 1, will be facing outwardly. The next tile is then interlocked with the corner tile by virtue of the interlocking tabs and is similarly leveled and secured using the elongated suspension members. In the matrix of ceiling tiles as assembled, tiles are supported and aligned through a combination of the elongated suspension members, the interlocking mechanisms and through cooperation of the side wall flanges. Preferably, a string is used across the room at the level lines to ensure that the ceiling is installed level.

Figure 23:
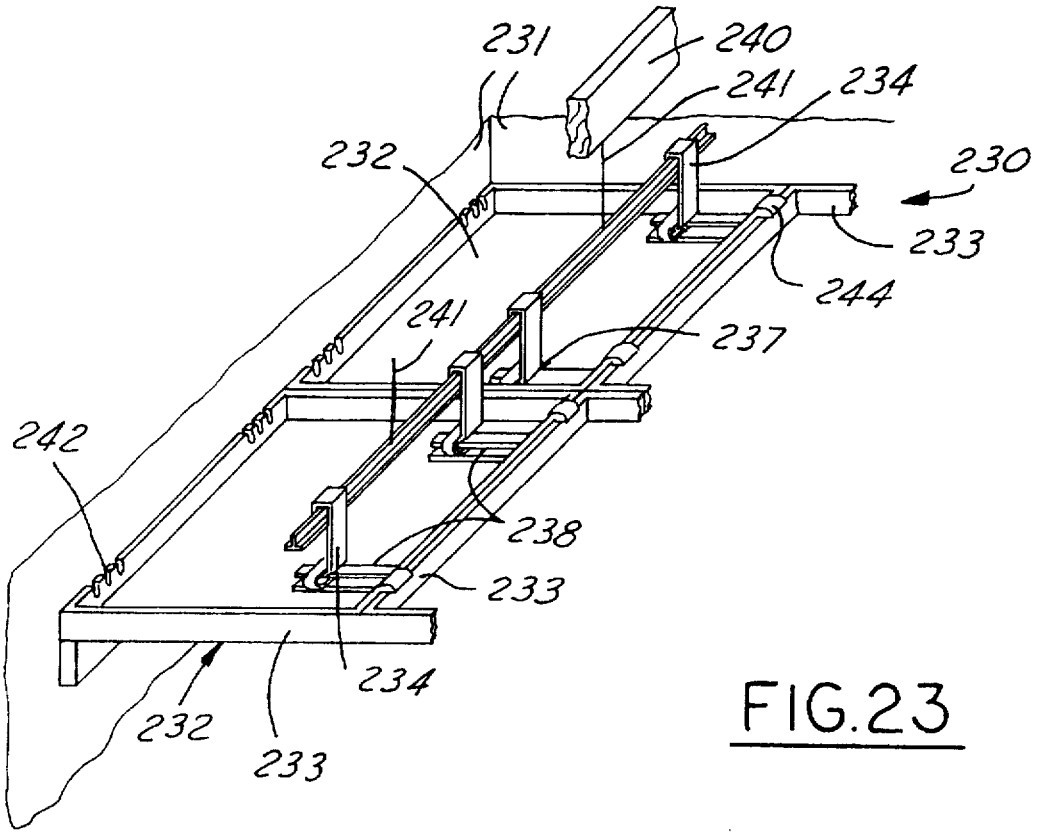
FIG. 23 is a perspective view of yet another embodiment of a ceiling tile system supported by a support structure.

Referring now to FIG. 23, yet another alternative ceiling tile system 230 is shown suspended between walls 231 of a room. In this embodiment the plurality of ceiling tiles or panels 232 are preferably arranged in a regular array or matrix of rows and columns. It is to be understood that although the drawings depict tiles 232 as having a square geometry, rectangular, or other polygonal shapes may be employed as well as other alignment configurations such as alternating offsetting or staggered rows; such modifications are deemed to be within the scope of the present invention.

Each tile 232 is provided with an elongated suspension member 234 which is coupled at one end (the upper end) to a suspended support 235. The other or lower end 236 of each elongated suspension member 234 is provided with a generally T-shaped slot 237 which receives and engages a T-block 238 which is molded into back surface 239 of each tile 232. Each tile 232 is preferably provided with two such cooperating suspension member/tile attachment point assemblies. It will be appreciated by those skilled in the art that it may be possible to use fewer suspension/attachment sites or that more than two such sites may be desirable in a particular application.

Support 235 is preferably a T-shaped support commonly used in other suspended ceiling systems. This embodiment may, for example, be used as a replacement system for an existing suspended ceiling. Supports 235 are preferably parallel and extend across the room. The cross members (the members perpendicular to supports 235) of prior systems are not required and may be removed if used as a replacement system. However, other shape suspended supports 235 may be used.

Supports 235 are coupled to joists 240 by a wire 241 or flexible strap in a conventional manner. Preferably supports 235 run parallel to joists 240. However, the orientation of joists 240 and supports 235 is of little consequence. A sufficient number of wires 241 are spaced along the length of support 235 to support ceiling system 230. Wires 241 are coupled to supports 235 and joists in a conventional manner.

Along one edge of each ceiling tile 232, an interlock structure is provided which engages a mating interlock structure of an adjacent tile, provided along the edge thereof. Preferably interlock structures are formed integrally with vertically extending walls 233. Again, it may be desirable to use fewer interlocking sites or more than two such sites depending on the particular application. As will be described further below, interlock structure generally has a first interlocking structure 242 and a second interlocking structure 244. Thus, each tile preferably has both first interlocking structures 242 and second interlocking structures 244.

Tiles 232 are preferably formed in a similar manner as described above. Also similar materials as described above may be used.

Figure 24:
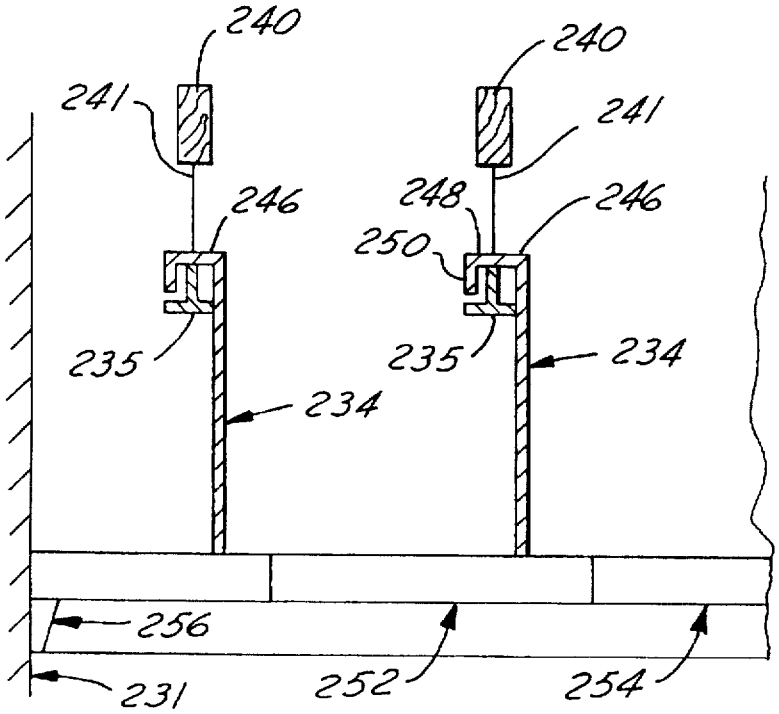
FIG. 24 is an elevational view of a ceiling tile system in accordance with FIG. 23.

Referring now to FIG. 24 of the drawings, ceiling tile system 230 is shown with like reference numerals depicting like parts and with a modified suspension/attachment configuration. Elongated suspension members 234 have a hanger portion 246 which connects to support 235. Hanger 246 preferably is shaped to orient elongated suspension members 234 in a vertical direction when installed on support 235.

Hanger 246 has a horizontal member 248 on which suspension member 234 is supported. A vertical member 250 extends from horizontal member 248 to prevent suspension member 234 from disengaging from support 235. In this embodiment, suspension member 234 rests against the top and against one side of support 235.

FIG. 24 also demonstrates that once installed, the show surfaces 252 of tiles 232 form a single co-planar ceiling tile surface 254 by virtue of the suspension system and interlocking tile features. Crown or wall molding 256, as shown, serves the traditional function of concealing the intersection of the perimeter tiles with wall surfaces 231 and supports the perimeter tiles.

Figure 25:
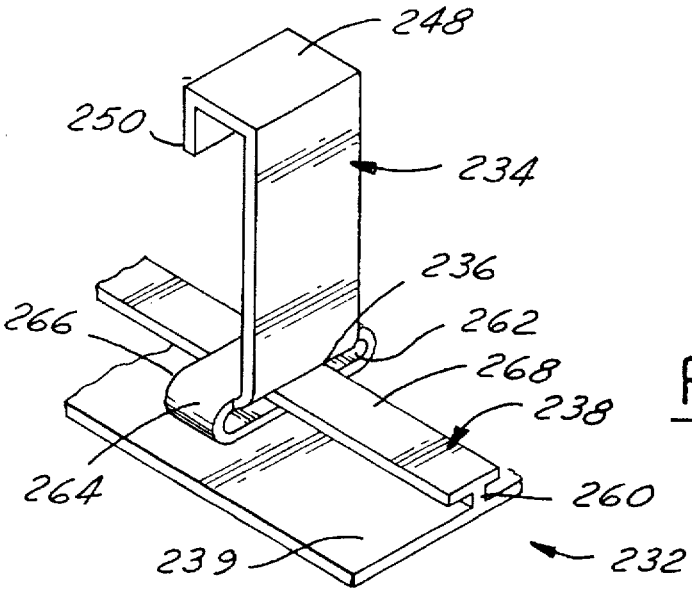
FIG. 25 is a perspective view of an elongated member used to support ceiling tile system.
Figure 26:
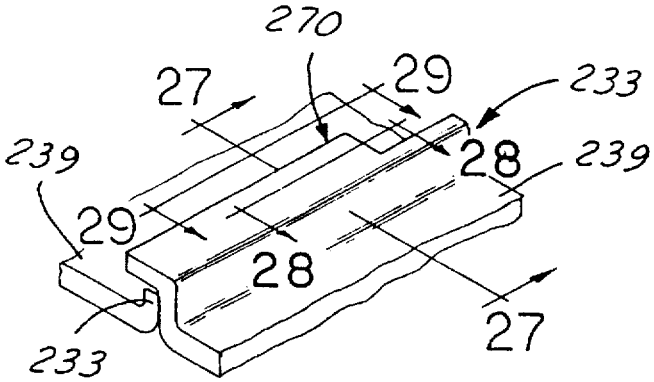
FIG. 26 is a perspective view of an interlocking structure for joining the edges of two adjacent ceiling tiles.
Figure 27:
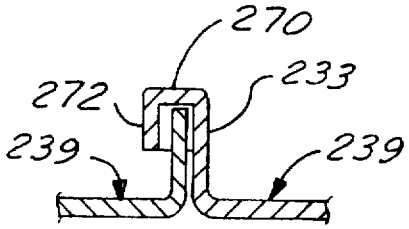
FIG. 27 is a cross-sectional view of a first and second interlocking structure along lines 27—27 of FIG. 26.

Referring now to FIG. 25, T-shaped block 238 is shown mounted on back surface 239 of tile 232. Block 238 is preferably integrally molded as a part of tile 232 although it is conceivable that block could be a discrete element attached by an adhesive or the like to the back surface 239 of tile 232. T-shaped block 238 is slightly modified from that of FIG. 10. That is, base 260 of T-shaped block 238 does not extend as far from back surface 239 as does FIG. 10. Thus, a modified T-shaped slot 262 accommodating the narrowed width is provided in elongated member 234.

Lower end portion 236 of elongated suspension member 234 has a receiver 264 defining a T-shaped slot 262. Preferably, receiver 236 is integrally formed with elongated suspension member 234. As illustrated, a pair of rounded arms 266 extend out from the vertical portion of elongated suspension member 234 are coupled between back surface 239 and top 268 of T-shaped block 238.

Referring now to FIGS. 26, 27, 28 and 29, adjacent tiles 232 are illustrated coupled together using first interlocking structure 242 and second interlocking structure 244. Each tile 232 is provided with a flange 270 along at least one vertical side wall. As described above, flange 270 may serve the purpose of a blackout flange to prevent light from showing between tiles 232. Flange 270 may also serve as part of second interlocking structure 244. Flange 270 preferably extends nearly across the entire tile 232 to increase the rigidity of the tiles. Flange 270 generally extends in a perpendicular direction to that of vertical wall 233 and parallel to back surface 239.

A second vertical wall 272 extends from flange 270. As shown best in FIG. 23, the length of second vertical wall 272 defines the extent of interlocking structure 242. That is, vertical wall 272 may extend only a portion of the length of an edge of tile 232. Second interlocking structure 244 has locating teeth 274 extending between vertical wall 233 and vertical wall 272. Locating teeth 274 allow the installer to obtain the proper fit between the tiles 232.

First interlocking structure 242 is comprised of at least one locating groove 277. Locating grooves 277 correspond to locating teeth 274. As tiles 232 are connected together, locating teeth 274 align with locating grooves 277 to properly position tiles 232 with respect to each other. Locating grooves 277 preferably have walls 279 defining the width of the grooves 277. Walls 279 are preferably angled toward the bottom of grooves 277. By angling walls 279, teeth 274 are then properly located once tiles 232 are assembled. The large opening where teeth 274 are inserted into grooves 277 help guide teeth 274 into position.

As shown in FIG. 23, two first interlocking structures 242 and two second interlocking structures 244 are placed on opposite edges of tiles 232. However, various numbers of interlocking structures may be incorporated onto each edge. Also, first interlocking structure 242, and second interlocking structure 244 may extend various lengths along the edges of tiles 232. For example, it is possible to have first interlocking and second interlocking structure extend completely across the distance of an edge of a tile 232. In one constructed embodiment, two second interlocking structures were used extending about 1¼ inches.

Figure 28:
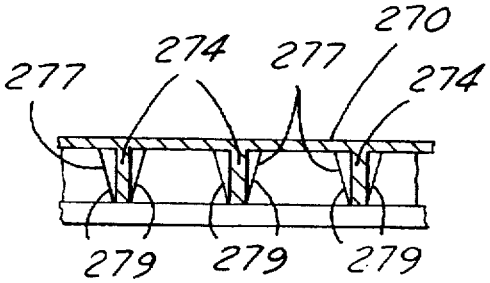
FIG. 28 is a cross-sectional view of first and second interlocking structure along line 28—28 of FIG. 26.
Figure 29:
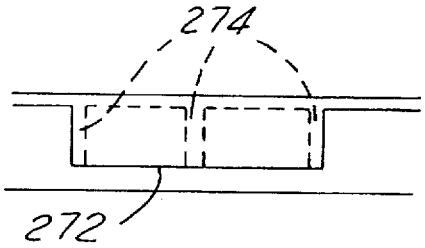
FIG. 29 is a side view of a first interlocking structure.

As shown best in FIG. 28, three locating teeth 274 are incorporated into one second interlocking structure 244. However, as few as only one locating tooth 274 may be incorporated into second interlocking structure.

Figure 30:
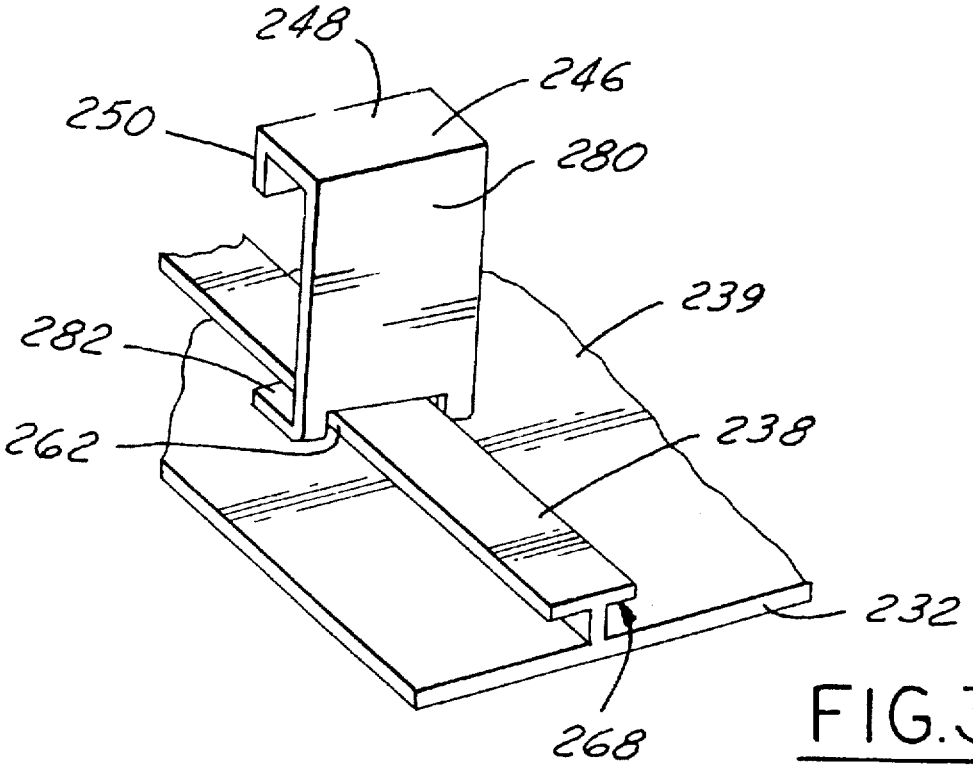
FIG. 30 is a perspective view of an alternative elongated member used to support ceiling tile system.
Figure 31:
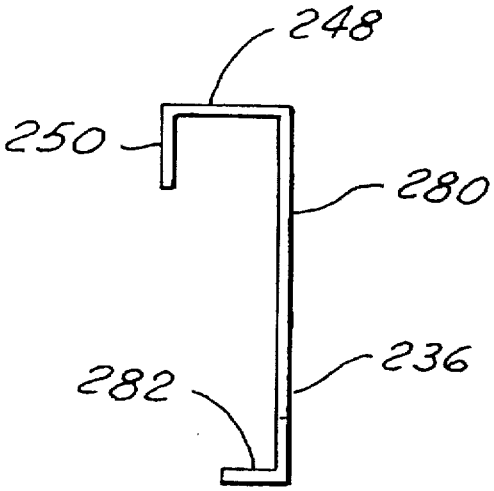
FIG. 31 is a side view of the elongated member of FIG. 30.
Figure 32:
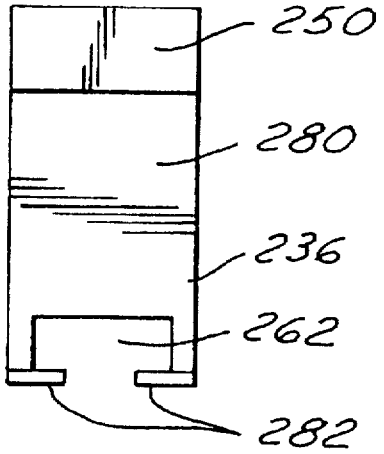
FIG. 32 is a front view of the elongated member of FIG. 30.

Referring now to FIG. 30, 31 and 32, an alternative elongated member 280 is shown with respect to a T-shaped block 238. Elongated member 280 has a hanger 246 similar to that of elongated member 234 of FIGS. 23–29. Lower end portion 236, however, has been slightly modified from that of FIG. 25. Lower end portion 236 has a T-shaped slot 262 stamped into lower end portion 236. Flanges 282 are also integrally formed near slot 262. Flange 282 extends in a horizontal direction from the lower portion of elongated member 280. Preferably, one flange 282 is located on each side of slot 262. Flanges 282 align with the channels defined between T-shaped block 238 and back surface 239 of tile 232. Flanges 282 extend between top 268 of T-shaped block 238 and back surfaces 239 of tile 232. Elongated member 280 is preferably formed in a single stamping operation.

Thus, it is apparent that there has been provided in accordance with the invention a method and apparatus that fully satisfies the objects, aims and advantages set forth above. While the invention has been described in connection with specific embodiments thereof, it is evident that many alternatives, modifications, and variations will be apparent to those skilled in the art in the light of the foregoing description. Also, it is apparent that any of the embodiments could be used with any other embodiment(s) depending on the requirements. Accordingly, it is intended to embrace all such alternatives, modifications and variations that fall within the spirit and broad scope of the appended claims.

What is claimed is:

1. A ceiling tile system, comprising:

a plurality of supported, adjacent and interlocked tiles, said tiles each having a principal surface and at least one elongated suspension member associated therewith;

one end of each of said elongated suspension members being attached to one of said tiles and at the other end thereof to an overhead structure; and each of said tiles further having at least a first interlocking structure on a first edge of each of said tiles and a second interlocking structure on a second edge of said tiles, said first and second edges being at opposite sides of each of said tiles, said first and second interlocking structures of said tiles engage and interlock adjacent tiles in said ceiling tile system;

said first interlocking structure having a first vertically extending wall having a locating groove;

said second interlocking structure having a second vertically extending wall, a first flange coupled to said second vertically extending wall and extending generally parallel to said principal surface, a third vertical wall extending from said flange and generally parallel to and spaced apart from said second vertical wall, and a locating tooth corresponding to said groove extending between the second and third vertical walls.

2. A ceiling tile system as recited in claim 1, further comprising a T-shaped block having a top and a base, said base coupled to a back surface of one of said tiles.

3. A ceiling tile system as recited in claim 2, wherein said elongated suspension member from comprises a pair of arms forming a slot sized to receive said T-shaped block.

4. A ceiling tile system as recited in claim 3, wherein said slot is T-shaped.

5. A ceiling tile system as recited in claim 3, wherein said arms are rounded and are received between a back surface of said tile and said top of said T-shaped block.

6. A ceiling tile system as recited in claim 1, wherein said elongated suspension member comprises a hanger portion and wherein said overhead structure comprises a suspended support, said hanger portion coupled to said suspended support.

7. A ceiling tile system as recited in claim 6, wherein said suspended support is T-shaped.

8. A ceiling tile system as recited in claim 6, further comprising a wire, said suspended support is suspended from a joist by a wire.

9. A ceiling tile system as recited in claim 1, wherein said locating groove has angled side walls.

10. A ceiling tile system as recited in claim 1, wherein said tiles are formed of molded plastic.

11. A ceiling tile system as recited in claim 1, wherein said elongated suspension members are formed of plastic.

12. A ceiling tile system comprising:

a plurality of suspended supports;

a plurality of supported, adjacent and interlocked tiles, said tiles each having a principal surface and at least one elongated suspension member associated therewith;

one end of each of said elongated suspension members being attached to one of said tiles and at the other end having a hanger portion sized to hang from said suspended supports; and each of said tiles further having at least a first interlocking structure on a first edge of each of said tiles and a second interlocking structure on a second edge of said tiles, said first and second edges being at opposite sides of each of said tiles, said first and second interlocking structures of said tiles engage and interlock adjacent tiles in said ceiling tile system;

said first interlocking structure having a first vertically extending wall having a locating groove;

said second interlocking structure having a second vertically extending wall, a first flange coupled to said second vertically extending wall and extending generally parallel to said principal surface, a third vertical wall extending from said flange generally parallel to and spaced apart from said second vertical wall, and a locating tooth corresponding to said groove extending between the second and third vertical walls.

13. A ceiling tile system as recited in claim 12, further comprising a T-shaped block having a top and a base, said base coupled to a back surface of one of said tiles.

14. A ceiling tile system as recited in claim 13, wherein said elongated suspension members comprises a pair of arms forming a slot sized to receive said T-shaped block.

15. A ceiling tile system as recited in claim 14, wherein said slot is T-shaped.

16. A ceiling tile system as recited in claim 14, wherein said arms are rounded and are received between a back surface of said tile and said top of said T-shaped block.

17. A ceiling tile system as recited in claim 12, wherein said suspended support is T-shaped.

18. A ceiling tile system as recited in claim 12, further comprising a wire, said support is suspended from a joist by said wire.

19. A ceiling tile system as recited in claim 12, wherein said locating groove has angled side walls.

20. A ceiling tile system as recited in claim 12, wherein said tiles are formed of molded plastic.

21. A ceiling tile system as recited in claim 12, wherein said elongated suspension members are formed of plastic.

22. A ceiling tile system comprising:

a plurality of suspended supports;

a plurality of supported, adjacent and interlocked tiles, said tiles each having a principal surface and at least one elongated suspension member associated therewith, said tiles having a back surface having a T-shaped block attached thereto;

said elongated suspension members having an upper end having a hanger portion and a lower end defining a T-shaped slot for receiving said T-shaped block, said hanger portion sized to hang from one of said plurality suspended supports; and each of said tiles further having at least a first interlocking structure on a first edge of each of said tiles and a second interlocking structure on a second edge of said tiles, said first and second edges being at opposite sides of each of said tiles, said first and second interlocking structures of said tiles engage and interlock adjacent tiles in said ceiling tile system.

23. A ceiling tile system as recited in claim 22, wherein said T-shaped slot is defined by a pair of arms extending outward from said elongated suspension member.

24. A ceiling tile system as recited in claim 23, wherein said arms are rounded.

25. A ceiling tile system as recited in claim 24, wherein each said T-shaped block has a top and a base, said base coupled to a back surface of one of said tiles.

26. A ceiling tile system as recited in claim 25, wherein said arms are rounded and received between a back surface of one of said tiles and said top of said respective T-shaped block.

27. A ceiling tile system as recited in claim 22, wherein said suspended supports are T-shaped.

28. A ceiling tile system as recited in claim 22, further comprising a plurality of wires, said suspended supports are suspended from a joist by a plurality of wires.

29. A ceiling tile system as recited in claim 22, wherein said tiles are formed of molded plastic.

30. A ceiling tile system as recited in claim 22, wherein said elongated suspension members are formed of plastic.

* * * * *